United States Patent [19]

Simkens

[11] 4,207,750

[45] Jun. 17, 1980

[54] APPARATUS FOR MAKING ICE BLOCKS

[76] Inventor: Marcellus C. P. L. Simkens, Kasteel Bloemendale, B - 8030 Beernem, Belgium

[21] Appl. No.: 916,861

[22] Filed: Jun. 19, 1978

[30] Foreign Application Priority Data

Jun. 27, 1977 [BE] Belgium ..... 256025

[51] Int. Cl.[2] ..... F25C 1/10

[52] U.S. Cl. ..... 62/138; 62/352

[58] Field of Search ..... 62/345, 352, 353, 340, 62/73, 138

[56] References Cited

U.S. PATENT DOCUMENTS

| | | | |
|---|---|---|---|
| 3,027,731 | 4/1962 | Lindenberg et al. | 62/138 |
| 3,130,536 | 4/1964 | Goldsborough | 62/352 X |
| 3,149,473 | 9/1964 | Archer | 62/353 X |
| 3,418,823 | 12/1968 | Vivai | 62/353 X |
| 3,526,100 | 9/1970 | Briel | 62/340 X |

*Primary Examiner*—Albert J. Makay
*Assistant Examiner*—William E. Topolcai, Jr.
*Attorney, Agent, or Firm*—Stevens, Davis, Miller & Mosher

[57] ABSTRACT

The apparatus for making ice blocks comprises a hollow body containing projecting parts faced downwards. Referigerating fluid and heating fluid are circulated separately through this body. A tray is around the projecting parts in its uppermost position. This tray is supported by a mechanism between an uppermost and a lowermost position and a water supply line comprising a cock opens into said tray. When ice has formed on the projecting parts, an electric circuit is closed and the cock opens for some time. Thus the tray falls. In the lowermost position water flows away out of the tray and therefore the tray rises up to its uppermost position.

8 Claims, 9 Drawing Figures

FIG. 1
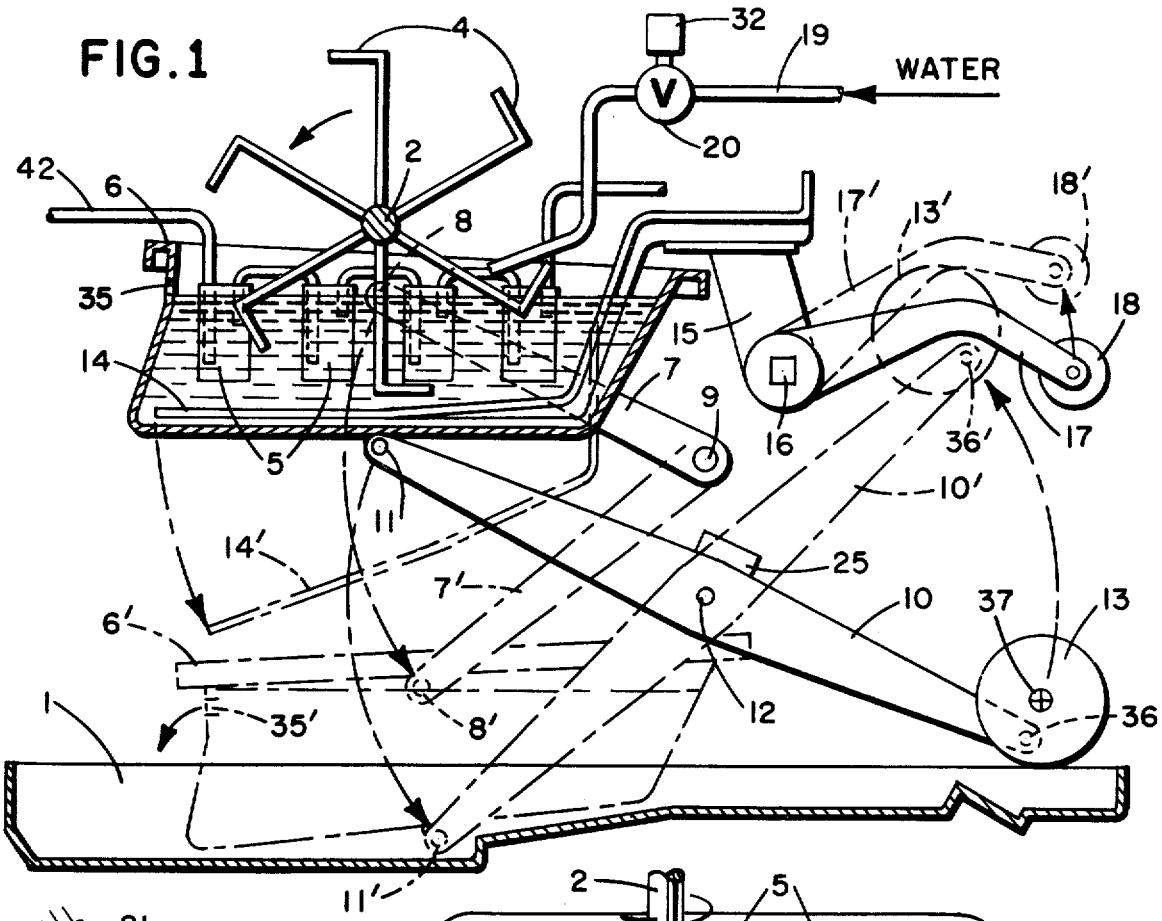
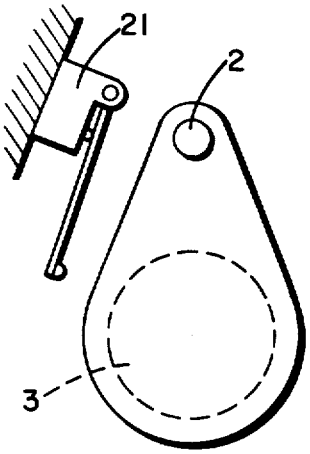
FIG. 3
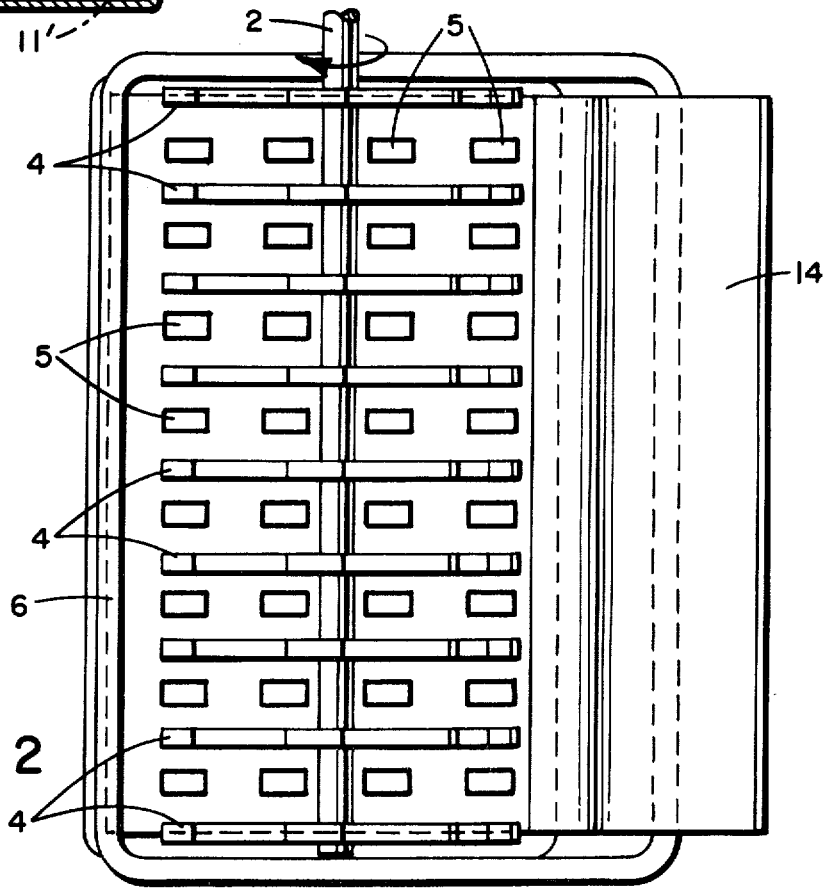
FIG. 2

APPARATUS FOR MAKING ICE BLOCKS

BACKGROUND

This invention relates to an apparatus for making ice blocks comprising a frame, a hollow body fixedly mounted on this frame and having downwardly projecting parts, means for circulating refrigerating fluid through said hollow body, means for circulating heating fluid through said hollow body, a small tray, a mechanism bringing said small tray from an uppermost position around the above said projecting parts to a lowermost position and conversely, a water supply line that opens into said tray, means that open and close said water supply line, and elements that control the said means and the said mechanism in such a way that: the means for circulating the refrigerating fluid through the body are in operation while the tray is in its uppermost position, the mechanism brings the tray from its uppermost position into its lowermost position when ice has formed on the projecting parts, the means for circulating heating fluid through the body come into operation after ice has formed on the projecting parts, and the water supply line is opened after ice has formed on the projecting parts.

The elements that control the mechanism and the means for circulating the fluids through the hollow body comprise e.g. a microswitch which is closed when a stirrer meets with resistance offered by the ice that has formed on the above named projecting parts, which then are in the tray that is occupying its uppermost position.

An apparatus comprising a microswitch that is closed when agitating members are impeded by the ice that has formed on projecting parts is known from the U.S. Pat. No. 3,027,731.

In practically known apparatus of the kind referred to, closing of such microswitch causes to stop the circulation of the refrigerating fluid and to start the circulation of the heating fluid and causes also the action of the mechanism that first brings the small tray from its uppermost position into its lowermost position and then from its lowermost position into its uppermost position. Likewise, closing of the microswitch brings about the opening of the water supply line so that water flows into the tray.

In these known apparatus the mechanism that brings the tray from an uppermost to a lowermost position and conversely comprises a motor-speed reducer whose power is sufficient to bring about the upward and downward movement of the tray. In some embodiments of the prior art the amount of water added to the tray is determined by a float, which closes the supply line as soon as enough water has been added.

In some other embodiments of the prior art the use of a float is avoided by allowing the added amount of water exceeding the required amount to flow away, but in these embodiments opening of the water supply line has to be controlled by a time switch, a programmator or any analogous mechanism.

The motor-speed reducer bringing about the movement of the tray, the float mechanism and the time switch or the analogous mechanism determining the opening period of the water supply line, are elements that complicate the apparatus for making ice blocks and strongly influence the cost price.

Apparatus comprising a small tray that is tilted automatically when ice blocks are formed and thereupon is again automatically filled with water are known from the U.S. Pat. Nos. 3,149,473 and 3,526,100. These prior art apparatus however, comprise an additional water-tank and a rather complicated mechanism for keeping the tray locked during the formation of the ice blocks and for keeping it unlocked after said formation, and for effecting the additional tank to be filled as well as for the water to overflow out of this tank into the tray.

On the contrary, in the apparatus according to the present invention essentially a downward movement of the tray is brought about by the fact that water is flowing into the tray when the ice blocks have been formed, and an upward movement is brought about by the fact that water is flowing away out of the tray being in its lowermost position.

Another apparatus comprising a tilting tray is known from the above cited U.S. Pat. No. 3,027,731. In this prior art apparatus tilting is effected by means of a rather sophisticated motor-driven mechanism.

According to the U.S. Pat. No. 2,443,203 a tilting movement, not of the tray wherein the ice blocks are formed but of a trough wherein this tray is fixedly mounted, is brought about by filling this trough with water. However, the trough is not filled automatically when ice blocks have been formed and the tray wherein the latter are formed continues to occupy the same place with respect to the refrigerating line.

The automatic flowing away of the water and the evacuation of the ice from a stationary tray are known from the Australian patent specification No. 460,312. In this prior art apparatus the tray is filled by means of a pump, which of course has to be driven by a motor, and the tray continues to permanently occupy the same place with respect to the refrigerating line.

Finally it has to be noticed that the upward and downward movement of a tray wherein ice blocks are formed is known as such from the U.S. Pat. No. 3,418,823. This upward and downward movement takes place continuously during the formation of the ice blocks and not after their formation, whereas the water supply unlimitedly takes place between two formation cycles of ice blocks.

THE INVENTION

In none of these prior art apparatus the downward movement of the tray is brought about by an extremely simple mechanism as in the present invention from the fact that water is flowing into the tray when the ice blocks have been formed and the upward movement of the tray is effected by the fact that in the lowermost position an amount of water is flowing away out of the tray.

According to the present invention the mechanism bringing the tray from its uppermost into its lowermost position and conversely consists of:

an element that opens the water supply line to the tray when ice has formed around the projecting parts, means that allow water to flow away out of the tray in its lowermost position, and an element that closes the water supply line when the tray has reached its lowermost position.

According to an advantageous embodiment of the present invention the apparatus has such a mechanical suspension of the tray that in its lowermost position it forms an angle with the horizontal plane different from that formed in its uppermost position.

According to a special embodiment of the present invention mechanical suspension consists of at least two brackets or arms, which on the one hand are hingedly connected to the tray and on the other hand are hingedly connected to the frame, the four pivots forming a quadrangle, which is no parallelogram.

According to an efficient embodiment of the present invention one of the brackets or arms bears a mercury switch, which in the lowermost position of the tray interrupts an electric circuit, which interruption closes the water supply line.

Other peculiarities and advantages of the present invention will appear from the following description of apparatus for formation of ice blocks according to the present invention. This description is only given by way of example and does not limit the scope of the invention. The reference numerals relate to the accompanying drawings.

THE DRAWINGS

FIG. 1 is a partly schematic side view of an apparatus according to the present invention for the formation of ice blocks.

FIG. 2 is a partly schematic top view of a part of the apparatus represented on FIG. 1.

FIG. 3 is a side view of a detail of the apparatus of the foregoing Figure.

In the various figures the same reference numerals relate to the same elements.

DESCRIPTION OF THE PREFERRED EMBODIMENT

Figure 4:
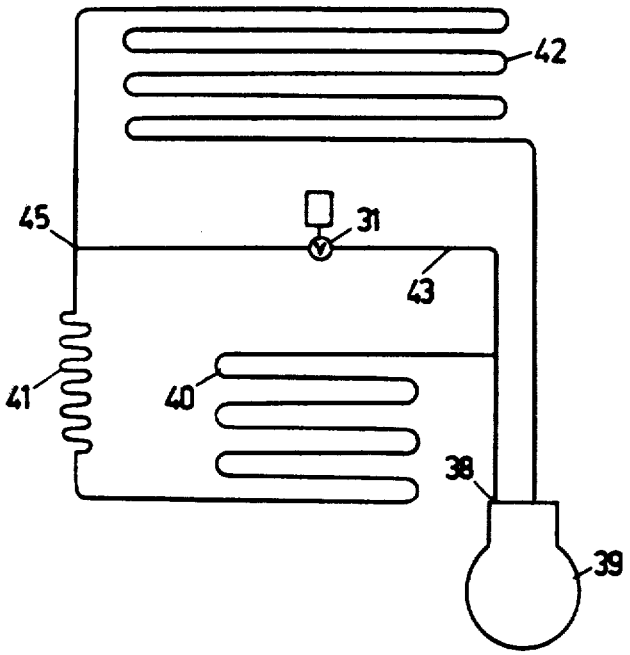
FIG. 4 is a schematic representation of the proper refrigerating mechanism of the apparatus according to the FIGS. 1 and 2.

The apparatus represented in the FIGS. 1 to 4 comprises a frame, which is integral with a bottom scale 1. In this frame the shaft 2 is rotatably mounted and to this shaft 2 a motor-speed reducer 3 is suspended.

A hollow body bearing downwardly projecting parts 5 is fixedly mounted on this frame. These downwardly projecting parts 5 form hollow blocks, which are interconnected by this body (evaporator) and consequently through the blocks a refrigerating fluid or a heating fluid can be circulated. A small tray 6 can be brought from the uppermost position represented in solid line in FIG. 1 to the lowermost position represented in dot-dash lines in the same Figures in a way that is described hereinafter. Various elements that cooperate with the tray 6 have been represented in FIG. 1 in solid line in the position they occupy when the tray 6 is at the top. They have been represented in dot-dash lines when they are in the position they occupy when the tray 6 is in its lowermost position. The same parts have been indicated in this second position with the same reference numeral with a prime mark.

In its uppermost position the tray 6 surrounds the hollow blocks 5. The paddles 4 that are fixedly mounted on the shaft 2 can move between the hollow blocks 5. The paddles 4 or the shaft 2 act as stirrers between the hollow blocks 5. As shaft 2 is bearing-supported in the frame but is not fixed to it, and as motor-speed reducer 3 is loose on shaft 2 and thus hangs on this shaft, the motor-speed reducer 3 either drives shaft 2 so that the shaft 2 rotates in the frame or the motor-speed reducer 3 rotates around the shaft 2, which then remains fixed. When the paddles 4 are moving through the water of the tray 6 the resistance of the water is not sufficient for impeding the rotation of the shaft 2 in the frame and the motor-speed reducer 3 continues to hang downwards in an almost fixed position. When on the contrary the paddles 4 are arrested by the ice that has been formed on the hollow blocks 5 in the tray 6, the shaft 2 becomes fixed with respect to the frame and the motor-speed reducer 3 makes a swivelling movement about the shaft 2. As will be described hereinafter, the motor-speed reducer 3 then strikes the microswitch 21 and brings it in closed position.

The tray 6 is hingedly mounted between the ends of a U-shaped bracket or arm 10. The pivots of the tray 6 with respect to this U-shaped arm 10 have been indicated by the reference numeral 11. Upon rising and falling the tray 6 is moving between the legs of the U-shaped arm 10, which is mounted in the frame in two pivots 12.

An arm 7 is hingedly connected to the tray 6 in the pivot 8. This arm 7 is fixedly attached to a shaft 9, which is bearing-supported in the frame. With respect to said frame the shaft 9 thus constitutes a pivot for the arm 7. Together with their pivots 8, 9, 12 and 11 the arms 7 and 10 form a quadrangle which is however no parallelogram. This quadrangle is such that the tray 6 in its uppermost position forms with the horizontal plane an angle different from that formed in its lowermost position. In the vertical wall of the tray an opening 35 has been left. This opening 35 may be adjustable, so that the speed at which the water flows through this opening is adjustable.

The difference between the angles that are formed by the tray 6 in the uppermost and in the lowermost position is such that water can flow away out of the tray through the opening 35 in the lowermost position, whereas in the uppermost position this opening 35 is above the water level. The arm 10, which is hingedly connected to the tray 6 and the frame, extends beyond the pivot 12 with the frame. This extension bears a disc-shaped counterweight 13, which is adjustable around a center of rotation 36, which in its turn does not coincide with the center of gravity 37 of said disc. The importance of this adjustment is explained below.

When the tray 6 is in its uppermost position it comprises a bearing plate 14, which is able to collect the ice blocks when they are released from the fixed hollow blocks 5. The bearing plate 14 is mounted to a bearing arm 15, which is fixed on the shaft 16, which in its turn is bearing-supported in the frame. Past the shaft 16 the bearing arm 15 is extended with an arm 17 whose end carries a counterweight 18. When the tray 6 falls, the bearing plate 14 passes from the position drawn in solid lines to the position drawn in dot-dash lines. The loose ice blocks laying on the bearing plate 14 slide down from it and fall into the fixed bottom scale 1 in which an opening has been left (not shown) through which the ice blocks fall into a container (not shown) placed under the bottom scale. Upon the upward movement the tray 6 catches the bearing plate 14 so that as soon as the tray 6 has again reached its uppermost position the bearing plate 14 again touches the bottom of the tray 6.

A water supply line 19 discharges into tray 6, when said tray is in its uppermost position. The supply line 19 is fixed with respect to the frame. In this line 19 a cock 20 has been mounted, which is controlled by a solenoid 32 which closes valve 20 when the tray 6 moves down.

The arm 10 carries a mercury switch 25, which depending upon the wiring it contains, may be either a simple switch opening and closing a circuit or a change-over switch.

Figure 5:
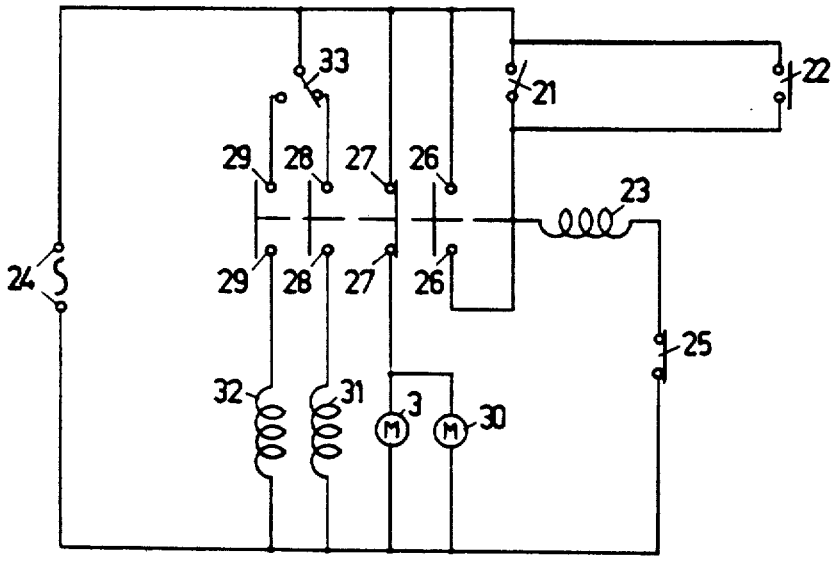
FIG. 5 is a first electric wiring diagram relative to the apparatus according to the foregoing Figure.

In the diagram of FIG. 5 the mercury switch 25, the microswitch 21, the voltage supply 24 and the solenoid 23 of a relay are connected in series. The relay controls the contacts 26, 28 and 29, which are open when the solenoid 23 is not energized, and the contact 27, which is closed when the solenoid 23 is not energized. The solenoid 23 being energized, the contacts 26, 28 and 29 are thus closed and the contact 27 is thus open. The contact 26 allows the passage of the supporting current, which holds the solenoid 23 energized until the circuit comprising the solenoid 23 is interrupted.

On the one hand the contact 27 is in series with the motor of the motor-speed reducer 3 and on the other hand it is in series with a motor 30 of the fan of the refrigerating mechanism.

This refrigerating mechanism represented in FIG. 4 consists of a circuit for the refrigerating liquid comprising a continuously working compressor 39, a condenser 40, a capillary line 41, and an evaporator 42. Said capillary line 41 maintains the pressure difference between the condenser 40 on the one hand and the evaporator 42 on the other hand. The hollow body with the hollow blocks 5 belongs to the evaporator 42. The motor 30 drives the fan (not represented in FIG. 4), which is mounted in front of the condenser 40. When the motor 30 and hence the fan are in action, refrigerating air is blown over the condenser 40. A bypass 43 comprising a valve 31 directly connects the exit 38 of the compressor 39 to the entrance 45 of the evaporator 42. As appears from the following description the valve 31 is mostly closed if the motor 30 of the fan of the condenser 40 is in operation, and said motor 30 in most cases is inoperative when the valve 31 is open.

When the valve 31 is closed and the motor 30 is driving the fan of the condenser 40, refrigerating liquid is flowing out of the said condenser 40 through the capillary line 41 to the evaporator 42 so as to evaporate therein and hence to withdraw heat from the water surrounding the hollow body with the hollow blocks 5.

If on the contrary the valve 31 is open and in addition the fan does not blow refrigerating air over the condenser, the gas leaving the exit 38 of the compressor 39 is led directly to the evaporator 42 through the bypass 43 so that a heating fluid is then flowing through the evaporator, which indeed does not function as an evaporator at that moment.

The contact 28 is disposed in series with the solenoid of the valve 31. When this solenoid is in a closed electric circuit, the voltage supply being connected to the terminals 24, the valve is open so that heating fluid is being circulated through the hollow body with the hollow blocks 5. When the electric circuit is open the valve 31 is in its closed position so that refrigerating fluid is circulated through the hollow body with the hollow blocks 5.

The contact 29 is disposed in series with the solenoid 32, which upon being energized opens the valve 20.

The contact 28 and the solenoid of the valve 31 on the one hand and the contact 29 and the solenoid 32 of the valve 20 on the other hand are not directly connected to the terminals 24 but are connected indeed by the help of a thermostatic switch 33. At its low temperature said switch makes the connection to the contact 28. This is the normal position of the switch 33, which only passes into the other position if heating fluid has flown through the hollow blocks for some time. In the said other position the thermostatic switch makes the connection to the contact 29.

The starting contact 22 is connected in parallel to the micro-switch 21. For the explanation of the normal operation of the apparatus the starting contact 22 can be left out of account. The mercury switch 25 is closed when the tray 6 is in its uppermost position and is opened when said tray is falling and thus also the arm 10 is changing its position.

When the tray 6 is in its uppermost position and not enough ice has been formed yet on the hollow blocks 5 so as to impede the blades 4 in their movement, the mercury switch 25 is thus closed and the microswitch 21 is open. The solenoid 23 of the relay is thus not energized; only the contact 27 is closed. The motor 3 is driving the shaft 2 and the motor 30 of the fan of the refrigerating mechanism is in operation. As the contact 28 is open, the solenoid of the valve 31 of the bypass 43 is not energized so that the fluid leaving the exit 38 of the compressor is led to the evaporator 42 via the condenser 40 and the capillary line 41. So, refrigerating fluid is flowing through the hollow blocks 5. As soon as the ice layer has grown to a certain thickness on said hollow blocks 5, it impedes the passage of the paddles 4 and hence the rotation of the shaft 2 in the frame. The said shaft 2 being locked the motor-speed reducer 3 is now tending to rotate on the shaft 2. The motor-speed reducer 3 closes the microswitch 21. As a result thereof the solenoid 23 of the relay is energized, the contact 27 is opened and the contacts 26, 28 and 29 are closed.

Opening of the contact 27 has the effect that the motorspeed reducer 3 is not driven any longer and that the motor 30 of the fan of the refrigerating mechanism becomes inoperative.

As soon as the paddles 4 are released from the ice layer the microswitch 21 is opened again, but meanwhile the function of the latter has been taken over by the contact 26, which maintains the supporting current through the solenoid 23 of the relay. The thermostatic switch 33 is in the low temperature position, thus is not yet closing the circuit over the contact 29 and the solenoid 32, but it does close the circuit over the contact 28 and the solenoid of the valve 31 of the bypass 43. Thus heating fluid is pumped through the hollow blocks 5, so that the ice blocks are released from the hollow blocks 5 and fall onto the bearing plate 14. At the same time the thermostatic switch 33 is reaching a temperature that is sufficiently high to make this switch interrupt the connection to the contact 28 and to make the connection with the contact 29. The solenoid of the valve 31 thus does not continue to be energized any longer. The bypass 43 is thus sealed and the exit 38 of the compressor again thus remains only in contact with the evaporator 42 over the condenser 40 and the capillary line 41, but the refrigerating mechanism is not working effectively as yet since the motor 30 of the fan of the condenser 40 remains inactive as long as the contact 27 is open.

Owing to the fact that the thermostatic switch 33 has made connection to the contact 29, which contact is closed as yet, the solenoid 32 is energized whereby the cock 20 is opened. So, water is flowing through the line 19 into the tray 6. As a result thereof the tray 6 becomes heavy enough so as to pass from its uppermost to its lowermost position. The already released ice blocks thereby are sliding from the bearing plate 14 into the bottom scale 1 and thence into the container. Together with the tray 6 the arm 10 changes its position, which opens the mercury switch 25.

Thereby the circuit of the solenoid 23 is interrupted. This opens the contacts 26, 28 and 29 and closes the contact 27. The solenoid 32 is thus not energized any longer and the valve 20 is closed. The motor 3 is rotating again and so does the motor 30 of the fan of the condenser 40. As the valve 31 of the bypass 43 remains closed the refrigerating mechanism is now again efficiently circulating refrigerating fluid through the evaporator 42 and consequently through the hollow blocks 5 of the hollow body.

After some time the thermostatic switch 33 switches from the contact 29 to the contact 28, but this remains without effect because the contacts 29 and 28 are open. The filled tray allowing in its lowermost position to flow away water through the opening 35 gradually is loosing weight. After enough water has flown away through the opening 35, the tray and its contents have lost enough weight so as to be raised again by the counterweight 13. The blocks 5 are then back in the water. Ice can again be formed and the cycle can restart. When the tray 6 is rising the mercury switch 25 is again closed but this has no further effect as long as the microswitch 21 is open.

Figure 6:
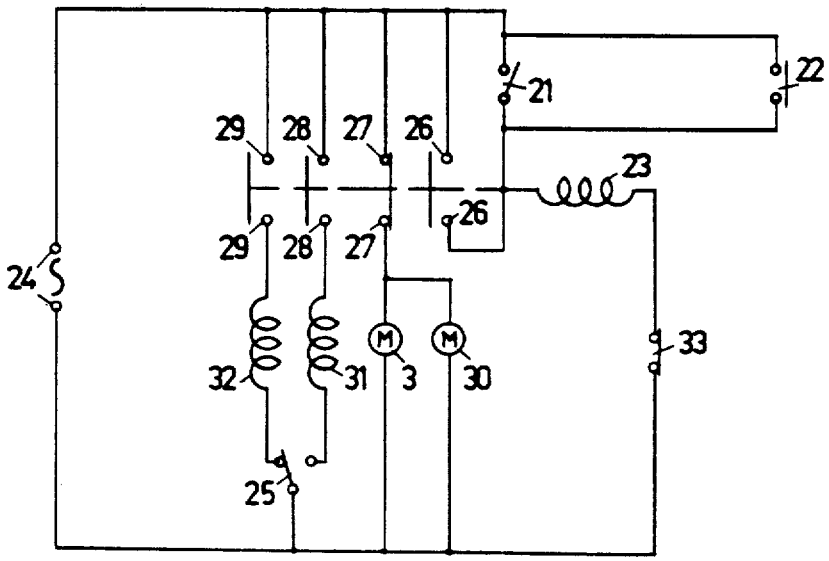
FIG. 6 is a second electric wiring diagram relative to the apparatus according to the FIGS. 1 to 4.

The electric wiring diagram of FIG. 6 differs from the electric wiring diagram of FIG. 5 by the following features:

a. The thermostatic switch 33 has not been executed as a changeover switch but as a simple interrupter and takes the place of the mercury switch 25; and b. the mercury switch 25 has not been executed as a simple interrupter but now as a change-over switch and in fact has taken the place of the thermostatic switch 33.

The mercury switch 25 closes the circuit over the solenoid 32 and the contact 29 when the tray is in its uppermost position and closes the circuit over the solenoid of the valve 31 when the tray 6 is falling and thus also the arm 10 is changing its position. Normally the thermostatic switch 33 is closed at low temperature and is only opened when the temperature exceeds a threshold value as a result of the flow of the heating fluid.

When the tray 6 is in its uppermost position and not yet enough ice has been formed around the hollow blocks 5 so as to impede the movement of the paddles 4, the microswitch 21 is open. So, the solenoid 23 of the relay is not energized; only the contact 27 is closed. The motor of the motor-speed reducer 3 is driving the shaft, the motor 30 of the fan of the condenser 40 remains in operation, and since, among other thing as a result of the fact that the contact 28 is open, the solenoid of the valve 31 is not energized, the bypass 43 is closed and the refrigerating fluid normally flows through the evaporator 42 and in consequence through the hollow blocks 5. In this way ice gradually forms around the hollow blocks 5. When the ice layer has grown to a certain thickness it obstructs the passage of the paddles 4 and thus impedes the rotation of the shaft 2 in the frame.

The shaft 2 being locked, the motor-speed reducer 3 now tends to rotate around the shaft. The motor-speed reducer 3 closes the microswitch 21. Thereby the solenoid 23 of the relay is energized, the contact 27 is opened and the contacts 26, 28 and 29 are closed.

The result of opening the contact 27 is that the motor-speed reducer 3 is not driven any longer and that the motor 30 of the fan becomes inoperative. As soon as the paddles 4 are released from the ice layer the microswitch 21 is re-opened, but meanwhile the function of the latter has been taken over by the contact 26, which maintains the supporting current through the solenoid 23 of the relay.

The thermostatic switch 33 is in the lower temperature position and keeps the circuit closed over the solenoid 23. The contact 29 closes the circuit over the solenoid 32, which opens the valve 20. The mercury switch 25 indeed is in the position wherein it closes the circuit over the solenoid 32 and the contact 29. Thus, water is flowing through the line 19 into the tray 6. Thereby the tray becomes heavy enough so as to pass from its uppermost into its lowermost position. Together with the tray 6 the arm 10 changes position, which makes the mercury switch 25 to change over from the connection to the solenoid 32 to the connection to the solenoid of the valve 31. The circuit of the solenoid 32 is interrupted thereby so that the valve 20 is closed and no water is added to the tray 6 any more. At the same time the circuit over the solenoid of the valve 31 is closed by the mercury switch 25, for the contact 28 is closed too. The valve 31 is thus opened and heating fluid is flowing through the hollow blocks 5. As a result thereof the ice blocks are released from said hollow blocks. The ice blocks fall on the bearing plate 14 and thence first slide into the bottom scale 1 and then into the container.

After some time the thermostatic switch 33 interrupts the circuit of the solenoid 23 of the relay. Thereby the contact 26 of the supporting circuit of the solenoid 23 is interrupted. The contact 27 is again closed, which again engages the motor-speed reducer 3 driving the shaft 2 and also puts the motor 30 into operation. At the same time the contacts 28 and 29 are re-opened. By the opening of the contact 28 the energizing of the solenoid of the valve 31 fails, so that the refrigerating mechanism again circulates refrigerating fluid through the hollow blocks 5. For some time to come the opening of the contact 29 has no effect because the mercury switch 25 closes the circuit not over the solenoid 32 of the valve 20 but over the solenoid of the valve 31 and the solenoid 32 was thus not energized any longer.

Figure 7:
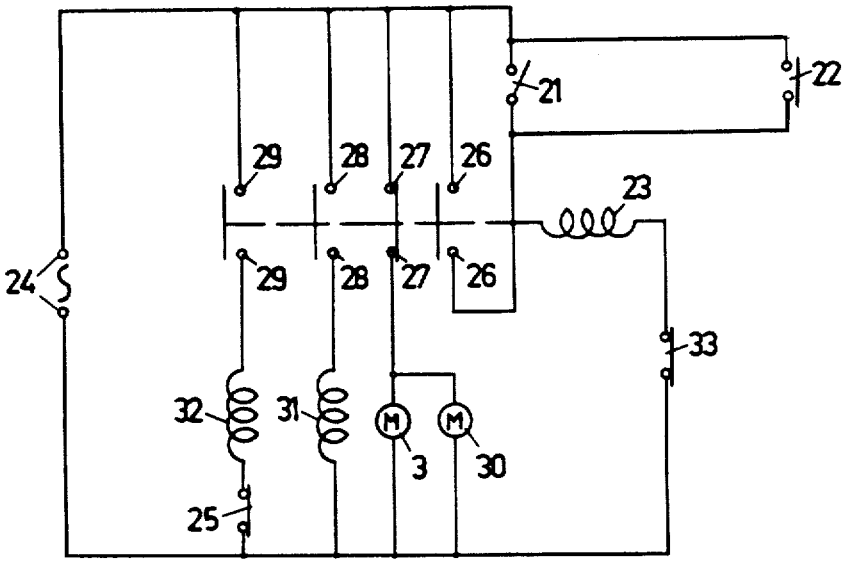
FIG. 7 is a third electric wiring diagram relative to the apparatus according to the FIGS. 1 to 4.

While the tray 6 is in its lowermost position water is flowing away through the opening 35 into scale 1. The combined weight of the tray and its contents is thus falling off. After enough water has flowed away through the opening 35 the tray 6 and its contents have lost enough weight so as to be raised back by the counterweight 13. The blocks 5 are then back in the water. Again ice can be formed and the cycle can restart. When the tray 6 is rising the mercury switch 25 again passes to the connection to the solenoid 32 but the circuit of the latter is then interrupted by the contact 29. The changing over of the mercury switch 25 has no effect for some time to come because the contacts 28 and 29 are open. If there has been enough cooling the thermostatic switch 33 is again closed but this has no effect as yet since the microswitch 21 is open. The electric wiring diagram according to FIG. 7 differs from the electric wiring diagram according to FIG. 6 by the fact that the mercury switch 25 has been designed not as a change-over switch but as an interrupter and is disposed in series only with the solenoid 32 of the valve 20.

From this it follows that when the contact 28 is being closed, the solenoid of the valve 31 is energized and remains so until the contact 28 is re-opened, which only occurs upon opening the thermostatic switch 33, after sufficient thawing. As long as the solenoid of the valve 31 is energized heating fluid is flowing through the hollow blocks 5 and thawing takes place. The closing of the contact 28 is attended by the closing of the contact 29.

The closing of the contact 29 results in the energizing of the solenoid 32 of the valve 20, but this energizing ceases as soon as the mercury switch 25 interrupts the circuit of the solenoid 32 upon the downward movement of the tray 6.

Figure 9:
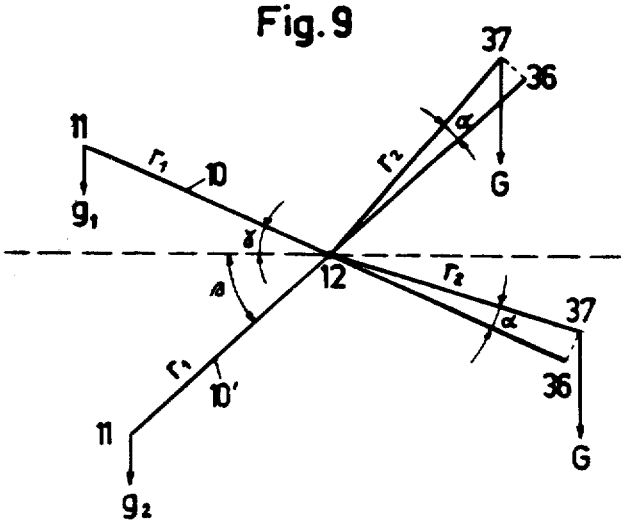
FIG. 9 is a graphic representation of forces acting upon a tray and upon the elements connected thereto of an apparatus according to the FIGS. 1 to 4.

The amount of water that has to leave the tray in the lowermost position does not depend upon the applied electric wiring diagram and can be approached as follows according to FIG. 9.

When the tray 6 is falling under the influence of the water added this tray is released from the hollow blocks 5, from the ice formed on them and from the bearing plate 14. In order to continue to fall the combined weight of the tray and its contents has to overcome also the friction in the pivots 8, 9, 11 and 12.

Let $g_1$ be the weight that has to be exerted by the tray 6 onto pivot 11 of the arm 10 when the tray is in its uppermost position in order to compensate for the influence of the counterweight 13.

$g_2$ The weight that has to be exerted by the tray 6 onto the pivot 11 of the arm when the tray is in its lowermost position in order to compensate for the influence of the counterweight 13.

G The counterweight.

36 The pivot of the counterweight 13 and the arm 10.

37 The center of gravity of the counterweight 13, which is mounted eccentrically on the arm 10.

$r_1$ The distance between the pivot 11 of the tray 6 with the arm 10 and the pivot 12 of the arm 10 with the frame.

$r_2$ The distance between the center of gravity 37 of the counterweight 13 and the pivot 12.

$\alpha$ The angle between the central axis of the arm 10 on the one hand and the line joining the pivot 12 and the center of gravity 37 of the counterweight 13 on the other hand.

$\beta$ The angle between the central axis of the arm 10 and the horizontal when the tray is in its lowermost position.

$\gamma$ The angle between the central axis of the arm 10 and the horizontal when the tray is in its uppermost position.

For the uppermost position of the tray there is equilibrium if $g_1 r_1 \cos\gamma = G r_2 \cos(\gamma - \alpha)$.

For the lowermost position of the tray there is equilibrium if $g_2 r_1 \cos\beta = G r_2 \cos(\beta + \alpha)$.

Therefrom it is deduced that $$\Delta g = g_1 - g_2 = G\frac{r_2}{r_1}\left[\frac{\cos(\gamma - \alpha)}{\cos\gamma} - \frac{\cos(\beta + \alpha)}{\cos\beta}\right]$$

All other elements of the formula being known, it can be deduced how large $\alpha$ has to be in order to obtain a determined value of $\Delta g$. $\Delta g$ has to be equal to the volume occupied by the immersed bodies multiplied by the density of the water. To the volume occupied by the immersed bodies has to be added the increase in volume proceeding from the formation of ice. Further the volume of the immersed bodies consists of the volume occupied by the hollow blocks, the volume occupied by the bearing plate and the volume occupied by the stirrer. To the weight thus calculated still has to be added the weight that is required to compensate for the frictional losses in the pivots.

The above explanation proceeds on the assumption that the arm 10 is symmetric with respect to the pivot 12, the weight of the tray acts completely at the pivot 11 and the influence of the arm 7 may be left out of consideration. Only the first of these three conditions is fulfilled. The other conditions especially are not fulfilled because the quadrangle formed by the pivots 8, 9, 12 and 11 is no parallelogram. This quandrangle has been chosen this way because the opening 35 in a side wall of the tray has to be above the water level if the tray is in its uppermost position and has to be below the water level if the tray is in its lowermost position. In the lowermost position a sufficiently large amount of water must be able to flow away out of the tray in order to bring about the weight difference $-\Delta g$.

After an amount of water has flown away corresponding with the weight $\Delta g$, the tray rises again. The fact that the tray in its uppermost position has an inclination differing from that in its lowermost position has an analogous effect as the eccentricity of the counterweight. The fact that the said quadrangle is no parallelogram corresponds with a weight difference between the influence of the tray 6 on the pivot 11 in the lowermost position with respect to the uppermost position. This weight difference $\Delta g'$ can be graphically determined and the above formula has to be corrected as follows:

$$\Delta g - \Delta g' = G\frac{r_2}{r_1}\left[\frac{\cos(\gamma - \alpha)}{\cos\gamma} - \frac{\cos(\beta + \alpha)}{\cos\beta}\right]$$

At first glance it has to be deduced from the above explanation that upon every upward and downward movement of the tray 6 an amount of water is flowing away that is equal to the volume of water displaced by the immersed bodies and the volume caused by expansion upon the formation of ice. As a matter of fact the volume of water flowing away is smaller since during the downward movement of the tray the volume of the immersed bodies gradually decreases, and at the moment no body is immersed any longer the angle $\gamma$ is different from the angle the tray occupies in its uppermost position. However, this has no repercussion on the method of calculation.

The apparatus according to the FIGS. 1 and 2 can be built without stirrers 4, shaft 2, motor-speed reducer 3 and microswitch 21. For that purpose it suffices to mount a change-over switch 34 on the arm 10 or 7 or to have one of these arms or any other element moving together with the tray act upon such change-over switch. The change-over switch 34 is, e.g., a second mercury switch. The change-over switch 34 closes a circuit when the tray 6 is in its uppermost position and closes another circuit as soon as the tray 6 has fallen very slightly. If the change-over switch 34 is a mercury switch on one of the arms 7 and 10, a very slight drop of the tray 6 has to be sufficient for making the mercury switch operate.

The ice formation around the hollow blocks 5, which is accompanied by an increase in volume, is sufficient for causing a slight drop of the tray 6 and this slight drop has to be sufficient for making the change-over switch 34 turn. If originally the first circuit is closed and the second circuit is open, the first circuit has to be open and the second circuit has to be closed after the turn.

Figure 8:
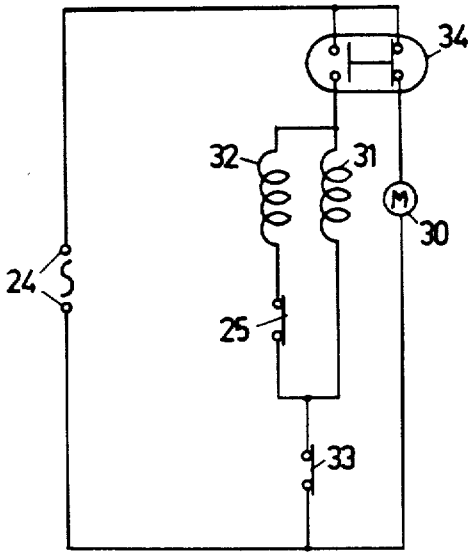
FIG. 8 is an electric wiring diagram with respect to a variant of the apparatus according to the FIGS. 1 to 4.

The electric wiring diagram according to FIG. 8 relates to such an embodiment. On the one hand the change-over switch 34 is in series with the motor 30 of the fan of the refrigerating mechanism and on the other hand it is in series with the solenoid of the valve 31 of the bypass 43 and with the solenoid 32 controlling the opening of the valve 20. When the tray 6 is in its uppermost position the change-over switch 34 closes the circuit of the motor 30. As soon as the tray 6 has departed a little from its uppermost position the change-over switch 34 closes the other circuit. As further appears from FIG. 8 the solenoid 32 is in series with the mercury switch 25, and the solenoid 32 and the mercury switch 25 on the one hand as well as the solenoid of the valve 31 of the bypass 43 on the other hand are in series with the thermostatic switch 33. Said thermostatic switch 33 just as in the other embodiment is at the end of the evaporator so that the thermostatic switch 33 only opens or again closes if the flow of the refrigerating fluid through the evaporator 42 has ceased relatively long ago or was back on process again relatively long ago. Moreover the difference between the temperature of closing and the temperature of opening of the thermostatic switch is relatively large.

The mercury switch 25 is closed when the tray 6 is in its uppermost position and requires a rotation through a larger angle for opening than the angle that is needed for making the change-over switch 34 to turn.

When the tray 6 is in its uppermost position and there has not yet formed enough ice on the hollow blocks 5 for making the change-over switch 34 to turn, the circuit of the motor 30 of the fan of the condenser 40 of the refrigerating mechanism is closed. The other circuit is open so that the solenoid 32 is not energized, the valve 20 is closed and no water supply is taking place. The circuit of the solenoid of the valve 31 of the bypass 43 is interrupted too, so that this solenoid is not energized and the bypass is closed. So, the refrigerating mechanism is circulating refrigerating fluid through the hollow blocks 5 and ice is being formed around these blocks. As soon as a certain amount of ice has formed, the tray 6 slightly falls as a consequence of the increase in volume resulting therefrom. This makes the change-over switch 34 to turn so that the circuit of the motor 30 is interrupted. The fan is not blowing cool air over the condenser 40 of the refrigerating mechanism any longer. At the same time the circuits of the solenoid of the valve 31 and of the solenoid 32 controlling the valve 20 are closed. The valve 31 thus opens the bypass 43 so that the fluid leaving the compressor 39 is directly led to the evaporator 42, which is then not acting as an evaporator any longer. Heating fluid is thus flowing through the hollow blocks 5. Water is flowing through the valve 20 into the tray 6. After some time said tray 6 is heavy enough for passing from its uppermost position to its lowermost position. The tray 6 falling still further, the change-over switch 34 is maintained in the position wherein the circuit of the motor 30 is interrupted and the circuits of the solenoid 32 and of the solenoid of the valve 31 are closed. By the circulation of the heating fluid the formed ice blocks are released from the hollow blocks 5. Said ice blocks then slide from the bearing plate 14 into the bottom scale 1 and thence in the container (not represented).

Before the tray has fully reached its lowermost position, the mercury switch 25 interrupts the circuit of the solenoid 32. Thereby the cock 20 is closed. When the tray has come down and the cock 20 is closed, water is flowing from the tray through the opening 35. The size of the opening is such that only enough water has flown away out of the tray 6 for allowing said tray to rise back if the thermostatic switch 33 is already opened. When the temperature at the end of the evaporator 42 has risen enough, the thermostatic switch 33 opens so that also the circuit of the solenoid of the valve 31 is interrupted.

The bypass 43 is closed thereby and no longer heating fluid but again refrigerating fluid is led from the condenser 40 to the evaporator 42. The hollow blocks 5 thus receive again refrigerating fluid before the tray 6 rises again.

If enough water has flown out of the tray, this tray goes up again so that first the mercury switch 25 is again closed, which has no consequence as yet since the thermostatic switch 33 is open, and thereupon the change-over switch 34 comes back into the position wherein it closes the circuit of the motor 30. The fan of the condenser 40 is then driven again and the normal refrigerating action can anew take place.

Only when the change-over switch 34 is back in the position wherein it closes the circuit of the motor 30, the thermostatic switch 33 is again closed so that the circuits of the solenoid 32 and of the solenoid of the valve 31 can be closed again when anew ice has formed around the hollow blocks 5.

It should be noticed that the thermostatic switch 33 has to close again with such a delay that this switch is still open when upon rising of the tray 6 the mercury switch 25 is again closed, since otherwise upon rising of the tray from the closure of the mercury switch 25 on until the interruption of the circuit of the solenoid 32 off the change-over switch 34, a certain amount of water would flow into the tray, which would make the amount of water in the tray too large and would result into an advanced fall of said tray.

It has to be noticed that according to the various embodiments the tray rises and falls by a mere addition and flowing away of water and that no further motor-speed reducer is needed in order to set the tray in movement.

For the rest the apparatus is completely composed of simple mechanical and electric elements that are simple and rugged, and hence guarantee a reliable operation.

The invention by no means is limited to the above described embodiments. Within the scope of the present application many modifications can be made to the described embodiments, among other things with respect to the form, the composition, the arrangement and the number of elements that are used for putting the invention into work.

E.g. with reference to FIG. 4 the refrigerating mechanism represented therein may be replaced by another refrigerating mechanism. In the embodiment according to FIG. 8 the change-over switch may be of another type. This change-over switch need not be mounted directly on one of the arms 7 and 10 either. The changeover switch may be connected to the tray by means of an indirect mechanical transmission.

The embodiment according to FIG. 8 may be combined with the use of a stirrer 4, a shaft 2, a motor-speed reducer 3 and a microswitch 21.

I claim:

1. An apparatus for making ice blocks comprising:

a frame, hollow parts fixedly mounted on the frame and projecting downwards, means for circulating refrigerating fluid through said parts, means for circulating heating fluid through said parts, a tray open at the top, a suspension mounted to the frame and carrying said tray so that it can move up and down between an uppermost position wherein the hollow parts are inside the tray, and a lowermost position, wherein the hollow parts are outside the tray, a counterweight on the suspension countering a downward movement of the tray, a water supply line discharging above said tray, means opening and closing said water supply line, a first element put into operation by ice formed on said projecting parts and bringing, after ice has been formed, said means opening and closing the water supply line in open position when the tray is in an upper part of its way between the uppermost position and the lowermost position, causing a water supply to the tray and subsequently, because of gravity, a downward movement of the tray, a second element bringing said means opening and closing the water supply line in closed position when the tray reaches its lowermost position, and means allowing water to flow away out of the tray in its lowermost position, causing a loss of water until the counterweight causes an upward movement of the tray.

2. The apparatus of claim 1, wherein the suspension of the tray is such that said tray in its lowermost position forms an angle with a horizontal plane greater than the angle it forms in its uppermost position and the means allowing water to flow away out of the tray in its lowermost position is an opening left in a side wall of the tray at the lowest end of the tray in its lowermost position.

3. The apparatus of claim 1, wherein the suspension comprises an arm hingedly connected to the tray and hingedly connected to the frame.

4. The apparatus of claim 3, wherein the arm has an extension beyond the pivot in the frame, the counterweight being mounted on said extension.

5. The apparatus of claim 4, wherein the center of gravity of the counterweight is outside the central axis of the arm.

6. The apparatus of claim 5, wherein the counterweight is pivotably fixed to the extension of the arm of a point a distance from its gravity center and is adjustable by pivoting whereby the distance between the center of gravity of the counterweight and the central axis of the arm changes.

7. The apparatus of claim 3, wherein the arm carries a mercury switch, which in the lowermost position of the tray interrupts an electric circuit so that the water supply line is closed.

8. The apparatus of claim 4, wherein the suspension consists of two arms that on the one hand are hingedly connected to the tray and on the other hand are hingedly connected to the frame, the four thus obtained pivots forming a quadrangle, which is no parallelogram.

* * * * *